US008581442B2

(12) United States Patent
Boys et al.

(10) Patent No.: US 8,581,442 B2
(45) Date of Patent: Nov. 12, 2013

(54) INDUCTIVELY COUPLED POWER TRANSFER SYSTEM

(75) Inventors: John Talbot Boys, Auckland (NZ); Grant Anthony Covic, Auckland (NZ); Dariusz Kacprzak, Auckland (NZ)

(73) Assignee: Auckland Uniservices Limited, Auckland (NZ)

( * ) Notice: Subject to any disclaimer, the term of this patent is extended or adjusted under 35 U.S.C. 154(b) by 646 days.

(21) Appl. No.: 11/912,967

(22) PCT Filed: Apr. 28, 2006

(86) PCT No.: PCT/NZ2006/000089

§ 371 (c)(1),
(2), (4) Date: Jul. 19, 2010

(87) PCT Pub. No.: WO2006/118474

PCT Pub. Date: Nov. 9, 2006

(65) Prior Publication Data

US 2010/0289340 A1 Nov. 18, 2010

(30) Foreign Application Priority Data

Apr. 29, 2005 (NZ) ..... 539770

(51) Int. Cl.
*H01F 38/14* (2006.01)

(52) U.S. Cl.
USPC ..... 307/104; 307/17

(58) Field of Classification Search
USPC ..... 307/104, 17
See application file for complete search history.

(56) References Cited

U.S. PATENT DOCUMENTS

| | | | | |
|---|---|---|---|---|
| 5,229,652 | A * | 7/1993 | Hough | 307/104 |
| 5,241,219 | A * | 8/1993 | LeBaron et al. | 307/104 |
| 5,821,638 | A * | 10/1998 | Boys et al. | 307/104 |
| 6,483,201 | B1 | 11/2002 | Klarer | |
| 6,483,202 | B1 * | 11/2002 | Boys | 307/17 |
| 6,686,823 | B2 * | 2/2004 | Arntz et al. | 336/174 |
| 7,077,045 | B2 * | 7/2006 | Dietrich et al. | 89/6 |

FOREIGN PATENT DOCUMENTS

| | | |
|---|---|---|
| JP | 2005260121 | 7/2005 |
| JP | 2006287988 | 11/2006 |
| WO | 2005/020405 A1 | 3/2005 |
| WO | 2005/036569 A1 | 4/2005 |

OTHER PUBLICATIONS

Jacobus M. Barnard et al. "Sliding Transformers for Linear Contactless Power Delivery", IEEE Transactions on Industrial Electronics, vol. 44, No. 6, Dec. 1998, p. 774-779.
English translation of Japanese Notification of Reasons of Rejection dated Apr. 12, 2011.

* cited by examiner

*Primary Examiner* — Fritz M Fleming
(74) *Attorney, Agent, or Firm* — Law Office of Richard F. Jaworski, PC

(57) ABSTRACT

An inductively coupled power transfer system has a power pick-up that uses an asymmetrical magnetically permeable core (103, 105, 106, 107). Such cores have been found to provide a significant increase in the output power for given losses and given core volume when transferring power from a primary conductive path (101) to a secondary coil (104) provided on the core.

15 Claims, 2 Drawing Sheets

INDUCTIVELY COUPLED POWER TRANSFER SYSTEM

CROSS REFERENCE TO RELATED APPLICATIONS

This application is a U.S. national phase of PCT/NZ2006/000089 filed Apr. 28, 2006, and claims the benefit of New Zealand Patent Application No. 539770 filed on Apr. 29, 2005, both of which are incorporated by reference herein. The International application published in English on Nov. 9, 2006 as WO 2006/118474 A1.

TECHNICAL FIELD

The present invention relates to the field of inductively coupled power transfer systems. The invention may have particular utility for inductively coupled power transfer systems for vehicles travelling along a track.

BACKGROUND

Inductive coupling is one known method for transferring power across coupled conductors without the need for physical connection between the conductors. An application of inductive coupling is to provide power to a movable vehicle running along a track.

FIGS. 1 and 2 show a schematic representation of a known inductively coupled power transfer (ICPT) system. FIG. 2 is a cross-section through the system. A primary coil or conductive path 1 carries alternating current, typically at a very low frequency (VLF) of about 5-50 kHz. The primary coil 1 has first and second conductors extending along two spaced apart sides 1*a*, 1*b*. A power pick-up for such a system includes a secondary coil 2 wound about a magnetically permeable core 3 (preferably a ferromagnetic core) which is located between the sides 1*a*, 1*b*. The ferromagnetic core concentrates the magnetic flux from the primary coil 1 and an electric potential is produced across the terminals of the secondary coil 2. The secondary coil 2 is typically tuned by a series or parallel capacitor. This electric potential is then rectified and converted to a required voltage. The ferromagnetic core 3 shown in FIG. 1 is E-shaped. Alternatively, an H-shaped core can and has been used.

The ferromagnetic core 3 and coil 2 may be provided on an electric vehicle that can travel on tracks that follow the path of the primary coil 1, or a set of primary coils 1. The output from the secondary coil 2 may be used to power the vehicle. U.S. Pat. No. 5,293,308 (Boys et al.) describes an ICPT system for an electric vehicle and the contents of this patent are hereby incorporated herein by reference.

One problem with inductive power transfer is the relatively large losses that occur in comparison to power transfer methods involving a direct physical connection. These losses increase the cost of operating any apparatus. It would therefore be advantageous if these losses could be reduced.

It is an object of the present invention to provide an ICPT system, or an ICPT system pick-up that has reduced losses in comparison to existing systems, or at least to provide the public with a useful alternative.

Unless the context clearly requires otherwise, throughout the description, the words "comprise", "comprising", and the like, are to be construed in an inclusive sense as opposed to an exclusive or exhaustive sense, that is to say, in the sense of "including, but not limited to".

SUMMARY OF THE INVENTION

In one aspect the invention consists in an ICPT system pick-up including an asymmetric magnetically permeable core.

In one embodiment the core comprises a first arm having first and second ends, a second arm that extends from the first arm at or closer to the first end in a direction substantially perpendicular to the first arm, and a third arm that extends from the first arm at or closer to the second end in an opposite direction to the second arm.

The core may further include a fourth arm extending parallel to the first arm from the second arm, so as to define a U-shape with the first and second arms.

A fifth arm may be provided extending from the first arm parallel to the third arm so as to define a U-shape with the first and third arms.

Alternatively or additionally a fifth arm may be provided extending from the third arm parallel to the first arm so as to define a U-shape with the first and third arms.

Preferably the pick-up includes a secondary coil wound about the first arm of the core.

In a further aspect the invention consists in an ICPT system including:

- a primary conductive path connectable to a power source for providing alternating current to the primary conductive path, the primary conductive path in use supplying electrical energy, the primary conductive path having first and second spaced apart conductors that extend along the path;
- a pick-up having a secondary coil provided about a magnetically permeable core, the secondary coil in use receiving electrical energy from the primary conductive path through inductive coupling;

wherein, at least when the secondary coil is coupled to the primary conductive path, the ferromagnetic core comprises a first arm that extends between the first and second conductors, the first arm having first and second ends, a second arm that extends from the first arm at or closer to the first end in a direction substantially perpendicular to the first arm, and a third arm that extends from the first arm at or closer to the second end in an opposite direction to the second arm.

Preferably the core includes one or more additional arms to allow a part of the core to define a U-shape about at least one of the first and second conductors.

Alternatively or additionally the core includes one or more additional arms to allow a part of the core to define a U-shape about both of the first and second conductors.

A fourth arm may be provided extending parallel to the first arm from the second arm, so as to define a U-shape about the first conductor.

The core may further include a fifth arm extending from the first arm parallel to the third arm so as to define a U-shape about the second conductor.

Alternatively or additionally a fifth arm may be provided extending from the third arm parallel to the first arm so as to define a U-shape about the second conductor.

In a further aspect the invention consists in an ICPT system comprising:

- a primary conductive path connectable to a power source for providing alternating current to the primary conductive path, the primary conductive path in use supplying electrical energy, the primary conductive path having spaced apart conductors defining first and second sides that extend along a first axis;
- a pick-up including a secondary coil wound about a magnetically permeable core, the secondary coil in use receiving electrical energy from the primary conductive path through inductive coupling;

wherein the ferromagnetic core comprises a first arm that extends between the first and second sides and is asymmetrical about an imaginary plane extending transverse to a plane through the conductors of the first and second sides.

Preferably the core comprises three, four or five arms.

In a preferred embodiment the core is shaped to define a U-shape about at least one of the conductors.

Alternatively or additionally the core is shaped to define a U-shape about both of the conductors.

In a further aspect the invention consists in a vehicle including an ICPT system pick-up as set forth in the preceding statements.

In a further aspect the invention consists in a vehicle powered by an ICPT system as set forth in the immediately preceding statements.

Further aspects of the present invention will become apparent from the following description, which is given by way of example only.

BRIEF DESCRIPTION OF THE DRAWINGS

A description of preferred embodiments of the present invention, at least as presently contemplated, will now be provided with reference to the accompanying drawings, in which:

FIGS. 3-6 show representations of four embodiments of a ferromagnetic core according to the present invention; and.

DESCRIPTION OF ONE OR MORE PREFERRED EMBODIMENTS OF THE INVENTION

Figure 3:
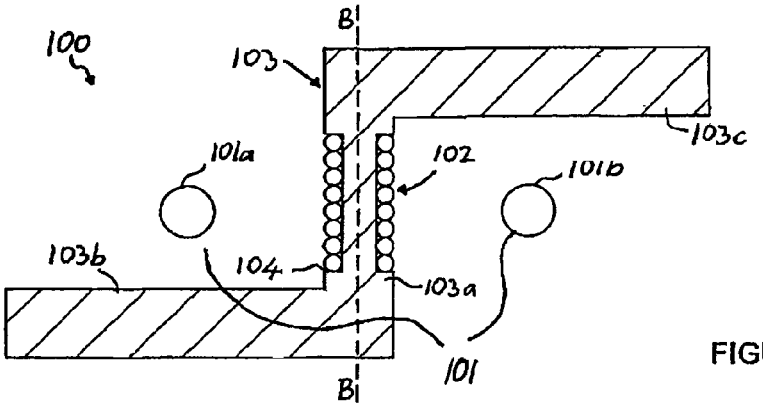

FIG. 3 is a schematic representation of a cross-section through part of an inductively coupled power transfer (ICPT) system 100 according to a first embodiment of the invention.

The ICPT system 100 includes a primary conductive path having conductor parts 101*a* and 101*b* extending into and out of the page. The primary conductive path 101 is connected to an alternating current source (not shown), which supplies power to the ICPT system 100. The first and second conductor parts 101*a* and 101*b* are supported by a suitable support structure (not shown).

A pick-up includes a secondary coil 102 wound about a ferromagnetic core 103, more particularly about a first arm 103*a* of the ferromagnetic core 103. As shown in FIG. 3, the first arm 103*a* may include a recess 104 into which the conductor of the secondary coil 102 is wound. At least during the time that the ICPT system 100 is transferring power from the primary conductive path 101 to the secondary coil 102, the first arm 103*a* is located between the conductors 101*a* and 101*b*, preferably centrally to the conductors 101*a* and 101*b*.

Power may be taken from the secondary coil of the pick-up using known circuits and methods. The secondary coil may be tuned by a capacitor, rectified and converted to the required voltage. Appropriate circuits for achieving this are described in U.S. Pat. No. 5,293,308.

The ferromagnetic core 103 includes a second arm 103*b* and a third arm 103*c*, which extend in opposite directions from opposite ends of the first arm 103*a*. Unlike the known E-shaped and H-shaped ferromagnetic cores that have been used in the past, the ferromagnetic core 103 is asymmetrical about a plane BB that extends through a mid-point between the first and second sides, transverse to the plane in which the primary conductive path is located.

The ferromagnetic core 103 may be provided on a vehicle (not shown), which moves along tracks (also not shown) that follow the path of the primary conductive path 101. To accommodate this travel, the support structure for the primary conductive path 101 and the support structure for the ferromagnetic core 103 needs to be appropriately shaped to allow the ferromagnetic core 103 to clear the support structure(s) for the primary conductive path 101.

Figure 4:
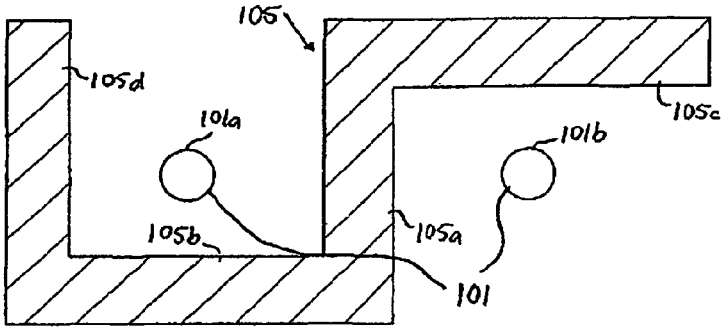
Figure 5:
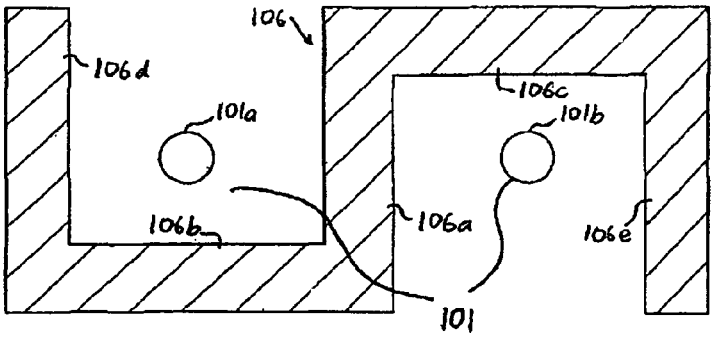
Figure 6:
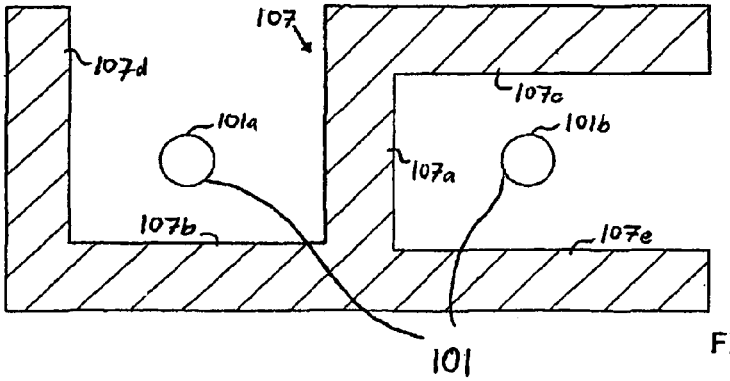

FIGS. 4-6 show three alternative ferromagnetic cores 105, 106 and 107. While the primary conductive path 101 remains unchanged, for each alternative ferromagnetic core, different support structures for the primary conductive path 101 and ferromagnetic core will be required to enable the ferromagnetic core to move along the primary conductive path 101. The secondary coil of the ICPT system is not shown in FIGS. 4-6, but is in practice provided on the first arm 103*a*.

Referring specifically to FIG. 4, a ferromagnetic core 105 includes first, second and third arms 105*a*-105*c* in the same configuration as the first to third arms 103*a*-103*c* of the ferromagnetic core 103. The ferromagnetic core 105 further includes a fourth arm 105*d* extending parallel to the first arm 105*a* from the end of the second arm 105*b*. The first arm 105*a*, second arm 105*b* and fourth arm 105*d* together form a U-shape about conductor part 101*a*.

Referring specifically to FIG. 5, a ferromagnetic core 106 includes first, second, third and fourth arms 106*a*-106*d* in the same configuration as the first to fourth arms 105*a*-105*d* of the ferromagnetic core 105. The ferromagnetic core 106 further includes a fifth arm 106*e* extending parallel to the third arm 106*c*. The first arm 106*a*, third arm 106*c* and fifth arm 106*e* together form a U-shape about conductor part 101*b*.

Referring specifically to FIG. 6, a ferromagnetic core 107 includes first, second, third and fourth arms 107*a*-107*d* in the same configuration as the first to fourth arms 105*a*-105*d* of the ferromagnetic core 105. The ferromagnetic core 107 further includes a fifth arm 107*e* extending parallel to the third arm 107*c* from the end of the second arm 107*b*. The first arm 107*a*, third arm 107*c* and fifth arm 107*e* together form a U-shape about conductor part 101*b*.

In two further alternative embodiments, the arm 107*d* may be omitted from the ferromagnetic core shown in FIG. 6, or both the arms 107*d* and 107*b* may be omitted.

The secondary coil 104 is preferably wound on the first arm of the ferromagnetic cores 105-107. The first arm may include a recess to receive the secondary coil 104.

From the foregoing description and FIGS. 3-6, it is clear that all the ferromagnetic cores 103, 105, 106 and 107 are asymmetrical. Specifically, the cores may be considered as being asymmetrical about an imaginary plane bisecting the primary conductive path 101. This asymmetrical characteristic of the ferromagnetic cores results in an increase in the output power for given losses and given core (e.g. ferrite) volume when transferring power from the primary conductive path 101 to the secondary coil 104, or equivalently reduced power input to the primary conductive path 101 is required to obtain the same power output from the secondary coil 104.

In the preferred embodiment of the invention, each ferromagnetic core 103, 105-107 is a single integrated component. Alternatively a ferromagnetic magnetic core may comprise two or more parts that abut each other or have a small air gap between them. Where the ferromagnetic core is provided in multiple parts, one part may be provided on a movable vehicle, the other part being stationary, located next to the primary conductive path 101 and extending along at least a portion of the primary conductive path 101, preferably the entire length of the primary conductive path 101 where inductive power transfer is to occur.

It will also be appreciated that the ferromagnetic cores 103, 105-107 may be inverted without affecting their operation.

Figure 1:
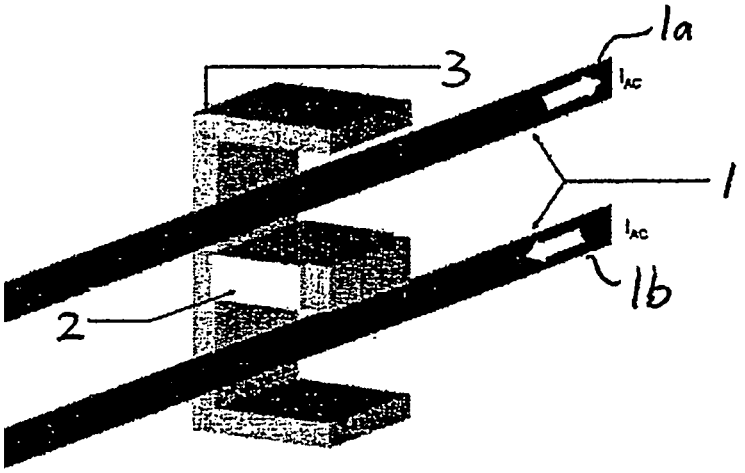
FIGURE 1 PRIOR ART
FIGS. 1-2 show schematic representations of part of a known inductive power transfer system.
Figure 7:
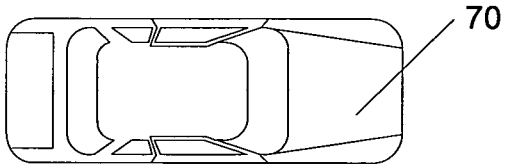
FIG. 7 shows a graphical representation of a vehicle to which embodiments of the present disclosure may applied.
Figure 2:
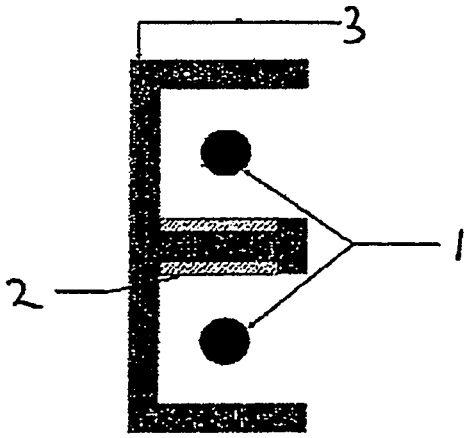
FIGURE 2 PRIOR ART

The shape of the ferromagnetic cores may be varied from those shown in FIGS. 3-6 without departing from the scope of the present invention. For example, the arms may be of different length or shape, but the asymmetrical nature of the ferromagnetic core as described herein above should be retained. Vehicles 70 (see FIG. 7) that receive some or all of their power from an ICPT system may make use of the invention to improve operating efficiency.

Where in the foregoing description reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. An inductively-coupled power transfer (ICPT) system pick-up including an asymmetric magnetically permeable core, wherein the core comprises a first arm having first and second ends, a second arm that extends from the first arm at or closer to the first end in a direction substantially perpendicular to the first arm, and a third arm that extends from the first arm at or closer to the second end in an opposite direction to the second arm, and whereby a primary conductor may be received on either side of the first arm.

2. The pick-up as claimed in claim 1 wherein the core further comprises a fourth arm extending parallel to the first arm from the second arm, so as to define a U-shape with the first and second arms.

3. The pick-up as claimed in claim 1 wherein the core further comprises a fourth arm extending from the first arm parallel to the third arm so as to define a U-shape with the first and third arms.

4. The pick-up as claimed in claim 1 wherein the core further comprises a fourth arm extending from the third arm parallel to the first arm so as to define a U-shape with the first and third arms.

5. The pick-up as claimed in claim 1 further comprising a secondary coil wound about the first arm of the core.

6. The pick-up as claimed in claim 1 wherein the core comprises a single integral component.

7. An inductively-coupled power transfer (ICPT) system comprising:

a primary conductive path connectable to a power source for providing alternating current to the primary conductive path, the primary conductive path in use supplying electrical energy, the primary conductive path comprising first and second spaced apart conductors that extend along the path;

a pick-up comprising a secondary coil provided about a magnetically permeable core, the secondary coil in use receiving electrical energy from the primary conductive path through inductive coupling;

wherein, at least when the secondary coil is coupled to the primary conductive path, the core comprises a first arm that extends between the first and second conductors, the first arm comprising first and second ends, a second arm that extends from the first arm at or closer to the first end in a direction substantially perpendicular to the first arm, and a third arm that extends from the first arm at or closer to the second end in an opposite direction to the second arm.

8. The ICPT system as claimed in claim 7 wherein the core further comprises one or more additional arms to allow a part of the core to define a U-shape about at least one of the first and second conductors.

9. The ICPT system as claimed in claim 7 wherein the core further comprises one or more additional arms to allow a part of the core to define a U-shape about both of the first and second conductors.

10. The ICPT system as claimed in claim 7 wherein the core further comprises a fourth arm extending parallel to the first arm from the second arm, so as to define a U-shape about the first conductor.

11. The ICPT system as claimed in claim 7 wherein the core further comprises a fourth arm extending from the first arm parallel to the third arm so as to define a U-shape about the second conductor.

12. The ICPT system as claimed in claim 7 wherein the core further comprises a fourth arm extending from the third arm parallel to the first arm so as to define a U-shape about the second conductor.

13. The ICPT system as claimed in claim 7 wherein the secondary coil is wound about the first arm of the core.

14. A vehicle including an ICPT system pick-up as claimed in claim 1.

15. A vehicle powered by an ICPT system according to claim 7.

* * * * *